US006719235B2

(12) United States Patent
Auf Der Maur et al.

(10) Patent No.: US 6,719,235 B2
(45) Date of Patent: Apr. 13, 2004

(54) METHOD AND DEVICE FOR PRODUCING REELS CONSISTING OF A LARGE NUMBER OF FLAT OBJECTS

(75) Inventors: Conrad Auf Der Maur, Gossau (CH); Walter Trecco, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/182,890

(22) PCT Filed: Jan. 12, 2001

(86) PCT No.: PCT/CH01/00022

§ 371 (c)(1),
(2), (4) Date: Aug. 1, 2002

(87) PCT Pub. No.: WO01/56910

PCT Pub. Date: Aug. 9, 2001

(65) Prior Publication Data

US 2003/0024096 A1 Feb. 6, 2003

(30) Foreign Application Priority Data

Feb. 4, 2000 (CH) ..... 229/00

(51) Int. Cl.[7] ..... B65H 39/14
(52) U.S. Cl. ..... 242/528; 242/541.5; 242/547
(58) Field of Search ..... 242/528, 541.4, 242/541.5, 541.6, 547

(56) References Cited

U.S. PATENT DOCUMENTS 1,058,658 A * 4/1913 Caulfield ..... 242/528
4,523,751 A 6/1985 Merkli
4,589,606 A * 5/1986 Staub ..... 242/528
4,768,768 A * 9/1988 Reist ..... 242/528
4,775,111 A * 10/1988 Kalin ..... 242/528
4,927,129 A * 5/1990 Merkli ..... 242/528

FOREIGN PATENT DOCUMENTS

CH 667 635 A 10/1988
EP 0 243 838 A 11/1987

* cited by examiner

*Primary Examiner*—William A. Rivera
(74) *Attorney, Agent, or Firm*—Rankin, Hill, Porter & Clark LLP

(57) ABSTRACT

For improving the quality of rolls (4) in which a large number of flat articles (2) are wound onto a roll core with the help of a winding tape (5), a local additional pressure force is exerted on the periphery of the roll (4) under formation during the winding process. For this purpose, the winding device, which in a known manner includes a device for holding a roll core (1), a device for supplying the articles (2) to a winding point (3) on the periphery of the roll core (1) or of the roll (4) under formation respectively, a device for feeding-in the winding tape (5) under tension to the winding point (3) and a drive for rotating the roll core (1) or of the roll (4) under formation, further includes at least one device (6) for generating the additional pressure force. This device (6), for example, includes a pressure roller (20), a pressure lever (21) and a compression drive (22) and advantageously is arranged such that the compression zone is situated, relative to the winding direction, about 15° to 60° behind the winding point (3).

13 Claims, 3 Drawing Sheets

METHOD AND DEVICE FOR PRODUCING REELS CONSISTING OF A LARGE NUMBER OF FLAT OBJECTS

BACKGROUND OF THE INVENTION

1. Field of the Invention

The invention is related to a method and a device for producing rolls out of large numbers of flat articles, particularly printed products.

2. Description of Related Art

For the purpose of transportation and intermediate storage, printed products (e.g. intermediate products straight from the printing press) are frequently rolled up in an imbricated formation to form rolls. For other flat articles, which are flexible at least to a limited extent, e.g. for textile articles, such rolls can represent advantageous formations for transport and/or storage.

The rolls as mentioned comprise a substantially cylindrical roll core and at least one winding tape, wherein the winding tape is wound onto the roll core together with the imbricated formation of the flat articles in a tensioned condition and holds the roll together. The end of the winding tape may be closed around the completed roll or fixed in another suitable manner. The winding tape usually has a width, which is significantly smaller than the width of the rolled-up articles. Printed products in most instances are rolled up in an imbricated formation; it is, however, also conceivable to roll the printed products arranged one behind the other, i.e., not overlapping one another.

Rolls as described above and as used in the printing field usually have a diameter of up to more than two meters and may weigh over one ton. The rolled-up products are, for example, approximately 30 to 50 cm wide and imbricated such that the product spacing amounts to around 10 cm or less. Usual winding tapes are approximately 5 to 10 cm wide.

For producing the rolls, winding devices are used comprising the following essential components: means for holding a roll core (usually comprising a horizontal winding axis), means for supplying the imbricated formation of flat articles to a winding point at the periphery of the roll core or of a roll under formation respectively, means for controlled feeding-in of the tensioned winding tape to the winding point and a drive for rotating the roll core or the roll under formation, respectively, at a substantially constant peripheral velocity, the drive acting either on the roll center or at its periphery. Winding devices of this type are described, for example in the publications EP-0243838 (or U.S. Pat. No. 4,775,111), EP-0281790 (or U.S. Pat. No. 4,898,336) or U.S. Pat. No. 4,523,751.

The means for supplying the imbricated formation, for example, comprise a pair of conveyor belts leading to the winding point essentially tangentially (e.g., to the zone of the lower zenith of the core or the roll under formation), on which conveyor belts the imbricated formation of articles is conveyed lying loosely. The winding tape is fed-in, for example, between the two conveyor belts such that the imbricated formation is guided to the winding point between the winding tape and the roll under formation. At the winding point, at which the supplied articles are taken over into the roll one after the other, the tensioned winding tape takes over the radial compression of the articles in the roll, this if so required somewhat assisted in the zone of the winding point by a corresponding pressure force exerted, for example, by the supplying device.

For adapting the winding device to the growing diameter of the roll under formation, either the supply means is correspondingly swivelled or else the axis of the roll core is correspondingly displaced. The winding drive, for example, acts on the roll core or on the periphery of the roll under formation in the zone of the winding tape.

For re-establishing the imbricated formation from a roll, i.e., for an unwinding process, the winding device is operated substantially in the opposite direction to the winding process, wherein the roll rotation is, for example, produced by actively pulling the winding tape off the roll.

It is found, that the rolls described above and their production and dissolution is less prone to problems, the smaller and more regular the thickness of the articles is, the less compressible the articles are and the less tightly the articles are arranged in the imbricated formation. In rolls made up of relatively thick, compressible and/or tightly imbricated printed products, the winding tape produces a constriction such that the products, at least in the outer layers of the roll under formation, bend outwards around the winding tape such that the roll has a greater circumference in the region of its two faces than in the central region, where it is held together by the winding tape. If, in addition, the products concerned are thicker on one side than on the other side, a dissymmetry is added to the constriction such that the two faces of the roll have different diameters.

The mentioned phenomenon can lead to problems due to the fact that they destabilise the roll and that the articles in the roll get damaged. Furthermore, as a result of the article deformation, the articles cannot assume a stable position in an imbricated formation re-produced from the roll. Problems may arise also on winding or unwinding because it becomes difficult to adapt the circumferential speed of a roll under formation or being unwound to the speed of a supply system or a conveying away system. The named problems are known in the printing field in particular for the winding of relatively thick printed products that are folded twice and of which in the roll, the second fold is aligned parallel to the roll axis such that unfolded product edges (smaller thickness) are lying on top of each other on the one roll face and first folds (greater thickness) are lying on top of one another on the other roll face. Products of this kind, for example, are twice folded newspapers or twice folded newspaper sections.

The invention sets itself the objective of improving method and device for producing rolls comprising a large number of flat articles, in such a manner, that the problems mentioned above occur less frequently and that therefore, also relatively thick, relatively compressible and/or irregular articles and in particular articles, which are thicker on one side, can be wound into rolls with better results, even when they are to be rolled in tight imbricated formations (small distances between adjacent articles).

SUMMARY OF THE INVENTION

In accordance with the present invention the flat articles in a roll under formation are, during the winding process, not only pressed against the roll core by the tensioned winding tape (central zone) and by their own stiffness (lateral zones), but they are temporarily subjected to an additional pressure force. During the winding process, the additional pressure force acts locally in a pressure zone on the periphery of the roll under formation and at a distance from the winding point. The pressure zone is substantially stationary and the additional pressure force comprises a component in the direction of the roll radius. The additional pressure force may, for example, be exerted over the whole width of the roll. Advantageously, however, the additional pressure force is restricted to lateral zones beside the winding tape reaching to the edge of roll face. Advantageously, the pressure zone is situated relative to the winding direction behind the winding point such that articles compressed by the additional pressure force reach the winding point soon afterwards to be covered by a further layer of articles.

It is found that, for the case of twice folded paper products, such as newspapers or newspaper sections, a temporary compression with an additional pressure force in the order of magnitude of some hundreds of Newtons (approximately 200 to 1000 N) is surprisingly effective. The additional pressure force is, for example, generated with the help of a passively rotating pressure roller pressed against the periphery of the roll under formation, the axis of the pressure roller being aligned parallel to the roll axis, and the pressure roller being arranged relative to the winding direction behind the winding point and at a distance from it. It is found that rolls wound with the additional pressure force according to the invention are wound more tightly and as a result are more stable. This is demonstrated, for example, by the fact that they flatten less when deposited standing on their periphery. It is also found, that rolls wound in this manner cause less problems on unwinding and also that the products from such rolls cause less problems during unwinding and during subsequent processing.

In rolls of folded printed products, the advantageous effect of the additional pressure force, which during the winding process acts on the outermost roll layer and through it also on layers located deeper in the roll, is probably at least in part attributable to an at least partially irreversible or at least not immediately reversible compression of the folded edges (in particular of the second fold) and compression (pressing out of air) of the products such that the products of a next roll layer are less deformed when first compressed by the winding tape on being taken over into the roll, than is the case without the additional pressure force.

The additional pressure force of the method in accordance with the invention is advantageous in particular for producing rolls, i.e. for winding processes. It can, however, be similarly used for unwinding operations.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
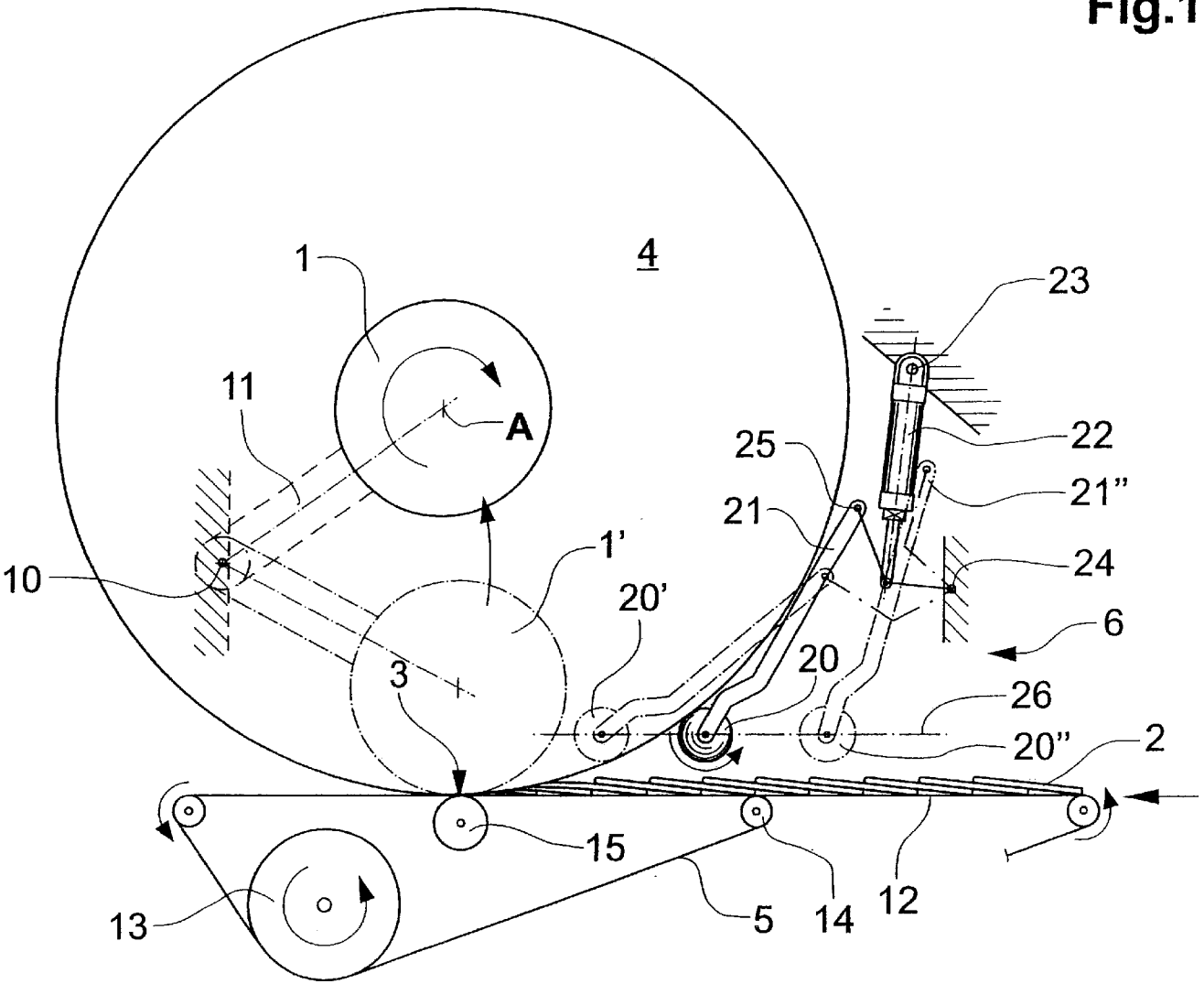
FIG. 1 shows an exemplary embodiment of the device according to the invention for producing rolls of flat articles (viewing direction parallel to the roll axis)

FIG. 1 shows with a viewing direction parallel to the roll axis A, an exemplary embodiment of the device according to the invention. This is a substantially known winding device, of which only the essential components are depicted, namely a means for holding a roll core 1, a means for supplying the flat articles 2 to a winding point 3 on the circumference of the roll core 1 or of a roll 4 under formation, means for feeding in and tensioning the winding tape 5, and a drive (not shown) for rotating the roll core 1 or the roll 4 under formation respectively in the direction of the arrow. In accordance with the invention, the winding device further comprises means 6 for generating an additional pressure force on the periphery of the roll 4 under formation in the device.

The means for holding a roll core 1 comprises a core arm 11 capable of being swivelled around a fixed core swivelling point 10. A roll core 1 arranged on the core arm is capable of being rotated around the roll axis A. The means for supplying the flat articles 2 to the winding point 3 comprises a pair of conveyor belts 12 running parallel and at a distance from one another (only conveying track depicted). The articles 2 are supplied in an imbricated formation lying loosely on the surface of these conveyor belts 12. The means for feeding-in and tensioning the winding tape 5 comprises a winding tape roller 13 capable of being rotated under braking and a tape deflector roller 14. For assisting the compression of the articles in the winding point 3, a roller 15 may be arranged in this zone, with the help of which the conveyor belts 12 and, with the conveyor belts 12, the supplied articles 2 and the winding tape 5 are pressed against the roll core 1 or the roll 4 under formation, respectively.

The means 6 for generating the additional pressure force comprises, for example, a pressure roller 20, a pressure lever 21 and a pressure drive 22, which are arranged, for example, on a support (not shown) such that the pressure drive 22 presses the pressure roller 20 by means of the pressure lever 21 against the periphery of the roll 4 being produced in the device. Advantageously, the pressure roller 20 is pressed against the roll 4 in a pressure zone, which is situated relative to the winding direction behind the winding point 3. If the winding point 3 is in the zone of the lower zenith of the roll 4 under formation, i.e. in about the 6 o'clock position, and if the winding direction is oriented clockwise, then, as is illustrated in FIG. 1, the pressure zone advantageously is approximately situated in a position between 4 and 5 o'clock position, possibly at a 5.30 hours position. In other words, the pressure zone is at an angular distance of between about 15° to 60° behind the winding point 3.

The pressure drive 22 is, for example, a piston/cylinder unit arranged to be swivelling around a fixed drive swivel point 23 and being, for example, operated hydraulically with a pressure variable in a controlled manner or a pressure being maintained constant. The pressure lever 21 is, for example, arranged swivelling around a fixed lever swivel point 24. The pressure lever 21 comprises a freely movable joint 25 and, between joint 25 and a lever swivel point 24, is joined to the piston/cylinder unit via an articulated joint. The pressure roller 20 freely rotates at the free lever end opposite the lever swivel point 24. The free lever end and/or the pressure roller 20 are guided by a guide 26, which is aligned approximately parallel to the supply conveyor belts 12. The guide 26 is schematically indicated in the drawing with a dot-dash line.

A winding process using the winding device illustrated in FIG. 1 proceeds as follows:

At the beginning of the winding process, the roll core is in its position designated with 1' and indicated with a dot-dash line. The winding tape 5 is wound on the winding tape roll 13 and its beginning is fixed to the periphery of the roll core 1. The pressure drive 22 is in a fully extended state or presses the pressure roller against a limit stop of the guide 26, advantageously such that the pressure roller 20 is at a distance from the roll core 1 (position of the pressure roller indicated with a dot-dash line and designated with 20'). As soon as the first layers of articles 2 has been wound onto the roll core 1, the pressure roller 20 commences to exert the additional pressure force while it rolls on the circumference of the roll 4 under formation. With the progressing winding process, the roll diameter gets bigger and the roll core 1 moves upwards. Simultaneously, the pressure roller 20 is pushed to the right in the guide 26, wherein the pressure force remains approximately the same.

The positions of the roll core 1 and of the pressure roller 20 indicated with an unbroken line illustrate approximately the end of the winding process.

FIG. 1 also illustrates a third position of the pressure roller 20 and of the pressure lever 21, indicated with a dot-dash line and designated as 20" and 21". This position is reached when the piston/cylinder unit is completely run-in and it serves for removing the pressure roller 20 from the area of the roll 4, for example, for an unwinding operation.

Figure 2:
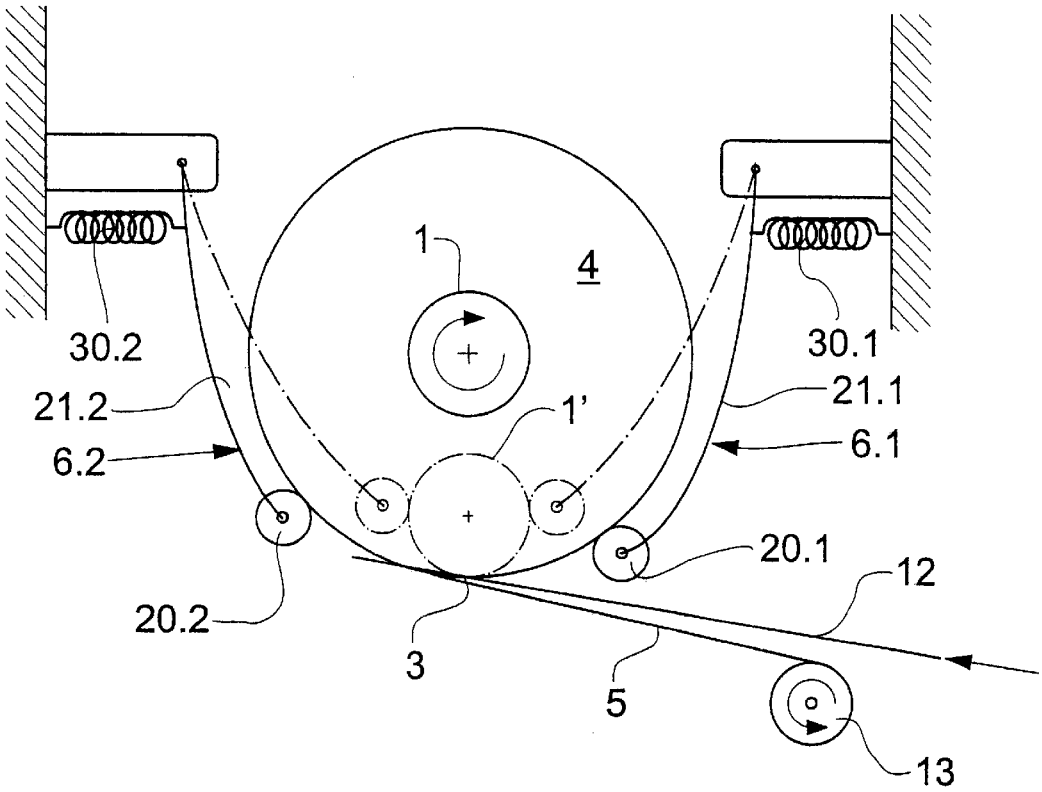
FIGS. 2 and 3 are schematic illustrations of two further, exemplary embodiments of the device in accordance with the invention (viewing direction parallel to the roll axis)
Figure 3:
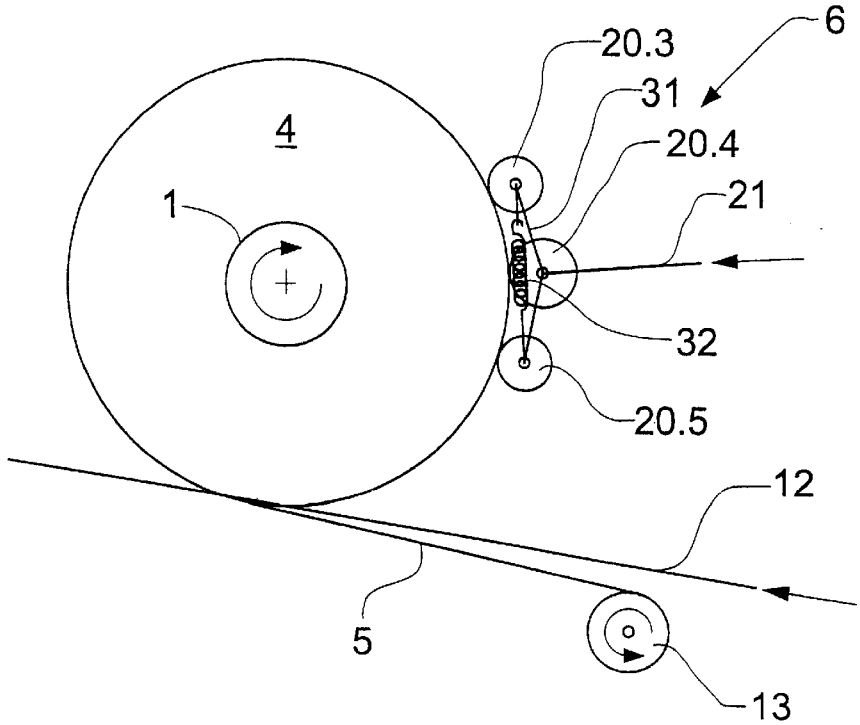

FIGS. 2 and 3 illustrate with the same viewing direction as FIG. 1, but significantly more schematically than FIG. 1, two further exemplary embodiments of the device in accordance with the invention. The components of the device are substantially the same as those of the device according to FIG. 1 and are, therefore, designated with the same reference numbers.

FIG. 2 illustrates an embodiment of the device according to the invention with two pressure zones, wherein one pressure zone is in front of the winding point 3 and the other pressure zone is behind the winding point 3. The two means 6.1 and 6.2 for generating the additional pressure force once again each comprise a pressure roller 20.1 and 20.2, a pressure lever 21.1 and 21.2, and a pressure drive in the form of a pressure spring 30.1 and 30.2, which drives the pressure levers 21.1 or 21.2 against the roll core 1 or against the roll 4 under formation, respectively, and presses thereagainst to provide the additional pressure force.

FIG. 3 depicts a means 6 for generating the additional pressure force, the means comprising a plurality of pressure rollers 20.3, 20.4, 20.5. In order for the arrangement of pressure rollers 20.3, 20.4, 20.5 to be able to adapt to the declining curvature of the roll circumference during the winding process, it comprises an articulated roller carrier 31, which is pre-tensioned by means of a pre-tensioning spring 32.

Figure 4:
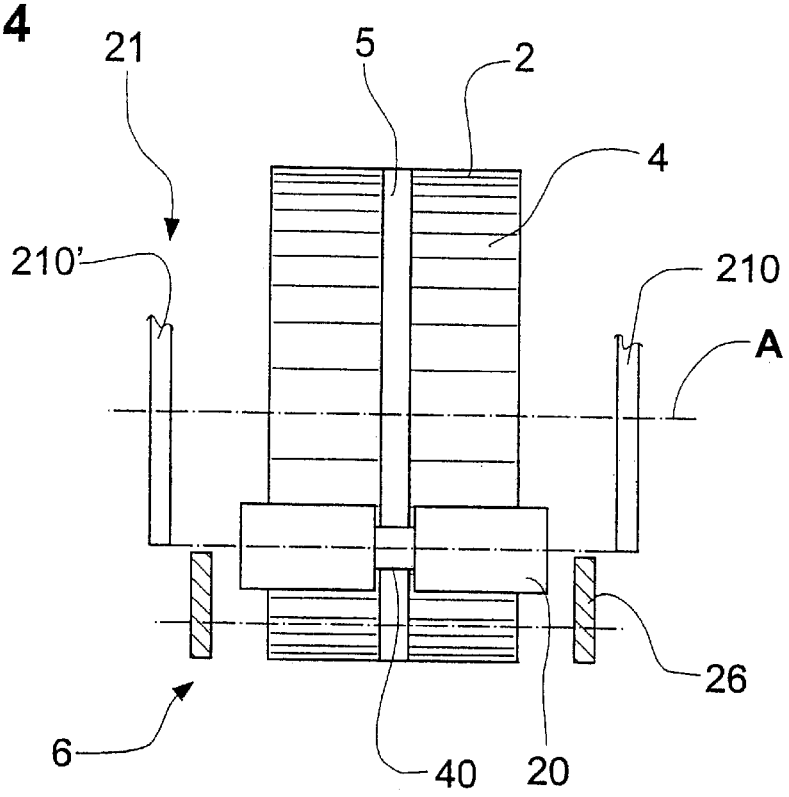
FIGS. 4 and 5 show two exemplary embodiments of means for generating the additional pressing force (direction of view at right angles to the roll axis).
Figure 5:
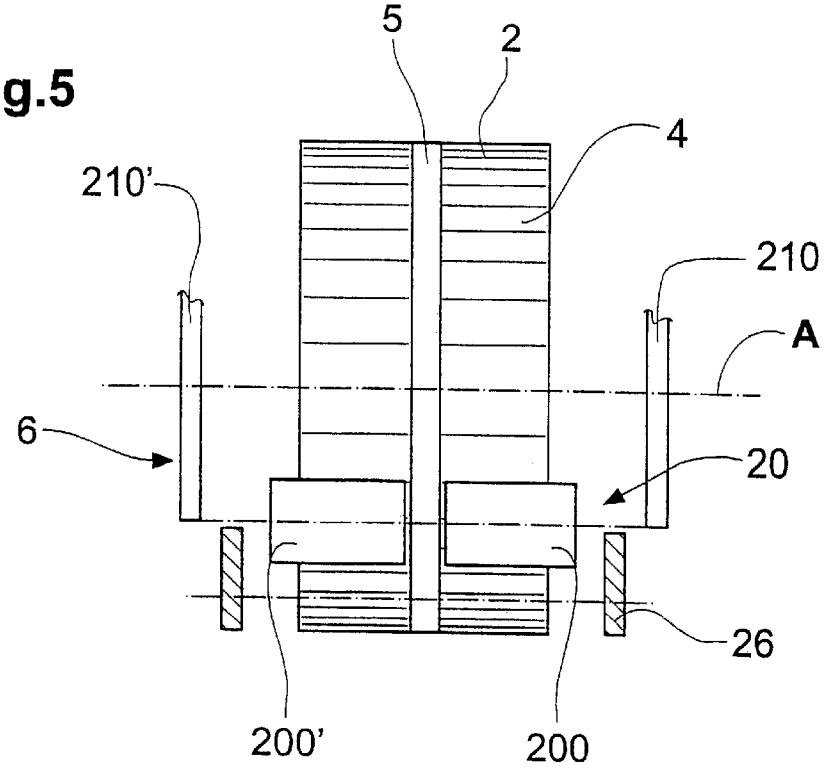

FIGS. 4 and 5 illustrate two further exemplary embodiments of means 6 for generating the additional pressure force (viewing direction at right angles to the roll axis A). A roll 4 with winding tape 5 is shown as well as parts of the means for generating the additional pressure force, namely the pressure rollers 20 and parts of pressure levers (21, 210, 210') and pressure roller guides (26).

FIG. 4 illustrates a pressure roller 20 having an axial length that is at least as great as the width of the wound-up articles 2 and with a central zone 40 having a reduced diameter. This central zone has an axial extent that is at least as great as the width of the winding tape 5. The pressure lever 21 is designed as a fork and on each side of the roll comprises a pressure lever part 210 and 210' carrying the pressure roller 20. By means of the reduced, central zone 40 of the pressure roller 20, the additional pressure force only acts on lateral zones of the periphery of the roll and not on the winding tape 5.

FIG. 5 shows parts of a means 6 for generating the additional pressure force, namely a two-part pressure roller 20, the partial rollers 200 and 200' of which are actuated independently of one another. The two partial rollers 200 and 200' are arranged substantially coaxially and each respectively is mounted on the pressure lever parts 210 and 210' freely rotating around an axle stub. In this case, for each pressure lever part 210 and 210' there is an own pressure drive (not illustrated) such that the compression exerted by the two partial rollers 200 and 200' are completely uncoupled from one another.

The pressure roller arrangement illustrated in FIG. 5 is particularly suitable for producing rolls of flat articles having different thicknesses on both sides of the winding tape, such as for the production of rolls from printed products being folded twice.

The pressure rollers as depicted in FIGS. 4 and 5, can also be used, for example, in devices as illustrated in FIGS. 1 to 3. They can also be combined with one another.

What is claimed is:

1. A method for producing rolls (4) from large numbers of flat articles (2), comprising the steps of:

driving a roll core (1) or a roll (4) under formation in rotation;

supplying the flat articles to a winding point (3) on the circumference of the roll core (1) or the roll (4) under formation, respectively;

feeding at least one winding tape (5) into the winding point (3) in a tensioned condition;

winding the supplied articles (2) together with the tensioned winding tape (5) onto the roll core (1) in a multitude of winding layers arranged one on top of the other; and wherein, during the winding process, an additional pressure force is exerted in a compression zone of the periphery of the roll (4) under formation by a pressing means (6) rolling passively on the periphery of the roll beside the at least one winding tape, wherein the compression zone is situated at a distance from the winding point (3) and the additional pressure force comprises a component in the direction of the winding radius.

2. The method according to claim 1, wherein the pressure force is exerted such that it acts on the periphery of the roll solely beside the at least one winding tape (5).

3. The method according to claim 1, wherein additional pressure forces are exerted in a plurality of compression zones.

4. The method according to claim 1, wherein the compression zone is situated, relative to a winding direction, behind the winding point (3) such that the additional pressure force acts on an outermost winding layer before it is covered by a further winding layer at the winding point.

5. The method according to claim 1, wherein the additional pressure force is exerted by a pressure roller passively rolling-off on the periphery of the roll.

6. The method according to claim 1, wherein the articles (2) are supplied in an imbricated formation.

7. The method according to claim 1, wherein the additional pressure force in the at least one compression zone is between about 200 N to 1000 N.

8. A device for producing rolls (4) from large numbers of flat articles (2), the device comprising means for holding a roll core (1), means for supplying the articles (2) to a winding point (3) situated on a periphery of the roll core (1) or of a roll (4) under formation, means for feeding-in at least one winding tape (5) under tension to the winding point (3) and means for driving the roll core (1) or the roll (4) under formation in rotation, wherein the device further comprises at least one pressing means (6) for generating an additional pressure force, said pressing means (6) being designed to roll passively on the periphery of the roll beside the at least one winding tape and, in order for the additional pressure force to act in a compression zone of the roll periphery, is located at a distance from the winding point (3) and comprises a component in the direction of the roll radius.

9. The device according to claim 8, wherein the at least one compression zone is situated, relative to the winding direction, behind the winding point (3) and is distanced from the winding point by between about 15° to 60°.

10. The device according to claim 8, wherein the pressing means (6) for generating the additional pressure force comprises at least one pressure roller (20) having an axis substantially parallel to the roll axis (A), at least one pressure lever (21) on which the pressure roller (20) is arranged freely rotating, and at least one pressure drive (22).

11. The device according to claim 10, wherein the pressure drive (22) is a piston/cylinder unit or a spring (30.1, 30.2).

12. The device according to claim 10, wherein the pressure roller (20) has an axial length that is at least as great as a width of the articles (2), and a central zone (40) with a reduced diameter, said central zone (4) having an axial extent that is at least as great as a width of the winding tape (5).

13. The device according to claim 10, wherein the pressure roller (2) comprises a pair of partial rollers (200, 200'), the partial rollers being arranged substantially coaxially and independent of one another, each of said partial rollers being actively connected with an associated pressure lever and an associated pressure drive.

* * * * *